United States Patent [19]

Kazuhiro

[11] Patent Number: 4,901,782

[45] Date of Patent: Feb. 20, 1990

[54] CENTRIFUGAL CASTING MOLD

[75] Inventor: Okazaki Kazuhiro, Okayama, Japan

[73] Assignee: Michihiro Giken Company, Okayama, Japan

[21] Appl. No.: 351,447

[22] Filed: May 12, 1989

[30] Foreign Application Priority Data

May 29, 1987 [JP] Japan ..... 62-134627

[51] Int. Cl.[4] ..... B22D 13/04; B22D 13/10

[52] U.S. Cl. ..... 164/293; 164/302

[58] Field of Search ..... 164/293, 292, 302, 340; 425/425

[56] References Cited

U.S. PATENT DOCUMENTS

| | | | |
|---|---|---|---|
| 1,485,860 | 3/1924 | Ladd | 164/293 |
| 1,489,036 | 4/1924 | Ladd | 164/293 |
| 1,500,708 | 7/1924 | Janney | 164/293 X |
| 1,693,283 | 11/1928 | Mix | 164/293 X |
| 3,091,009 | 5/1963 | Arnold et al. | 164/293 |
| 3,174,199 | 3/1965 | Trindler . | |

FOREIGN PATENT DOCUMENTS

| | | | |
|---|---|---|---|
| 55-36425 | 9/1980 | Japan . | |
| 922972 | 4/1963 | United Kingdom | 164/302 |

*Primary Examiner*—Richard K. Seidel
*Assistant Examiner*—J. Reed Batten, Jr.
*Attorney, Agent, or Firm*—Koda & Androlia

[57] ABSTRACT

The centrifugal casting mold is a divided-type mold which can be set in a continuous centrifugal casting apparatus for producing annular or cylindrical cast articles and which can process them automatically and rapidly. It is easy to remove cast articles out of the core mold because the core mold halves are usually separated by compression springs when the mold is in a stationary state, and that the such divided core mold halves are integrally combined for centrifugal casting by utilizing centrifugal force automatically generated during the rotation of the mold.

3 Claims, 9 Drawing Sheets

CENTRIFUGAL CASTING MOLD

BACKGROUND OF THE INVENTION

1. Field of the Invention

The present invention relates to a centrifugal casting mold and, more particularly, to a divided rotary mold for centrifugal casting arranged to efficiently produce annular or cylindrical articles from molten metal, such as cast iron and aluminum alloy. Articles cast by the mold according to the present invention are such that their outer surfaces are flat or uneven, and that their inner sides are flat, with their overall configurations being annular or cylindrical, so that the articles can be supplied as automobile parts or machine parts of various kinds.

2. Description of the Prior Art

Conventional centrifugal casting molds are generally of a draft-angled integral type in most cases, and the partially divided rotary molds have been utilized as centrifugal casting molds for producing articles having complex surface configurations. However, since most of the divided-type casting molds employ a mechanical screw fastening method or a clamping method, it is very troublesome to close the molds or to open the molds in order to remove articles, and such casting procedures are low in productivity. To be concrete, it is necessary, for example, to screw a bolt into or out of a nut at each segment of the molds in every casting operation.

It is a casting mold disclosed in Japanese Patent Publication No. 55-36425 that has solved the trouble of the bolt-nut clamping method. This divided-type mold is such designed that conical projections, which extend in a direction of the rotational center axis of the mold from both sides thereof, are supported in hollow conical sleeve bearings from both sides, that molten metal is supplied through one of the conical sleeve bearings into the mold, and that the other conical sleeve bearing is supported by a slide-spline axis so as to be movable in the axial direction and to transmit force for rotating the mold.

Even in the mold of this type, however, additional means for clamping the whole circumference of the mold from the outside is indispensable, and as the operation of such means is tedious, this type casting mold cannot be applied to a continuous casting apparatus.

SUMMARY OF THE INVENTION

A purpose of the present invention is to more tightenedly combine mold sections of an annular or cylindrical core mold, which are separated by compression springs during the mold stoppage, by utilizing centrifugal force generated during the rotation of the mold. For this purpose, the centrifugal casting mold of the present invention is so designed that weight ends of centrifugal pendulums, whose fulcrums are separated from the centers of gravity and which are attached in a movable state, are moved radially outwardly by the centrifugal force generated during the rotation of the mold, whereas the other ends of the centrifugal pendulums force the mold sections radially inwardly to concentrically retain them as the integral annular core mold without such weights.

That is to say, the characteristics of the centrifugal casting mold according to the invention reside in that this casting mold comprises radially plurally divided core mold sections, separating means for separating the divided core mold sections at predetermined intervals when the mold is in the stationary state, and centrifugal pendulums serving as uniting means for displacing the divided core mold sections radially inwardly to thereby combine them integrally when the mold is rotating, which centrifugal pendulums are supported with the centers of gravity being one-sided, while one end of each pendulum is adapted to force the rear side of the corresponding core mold section radially inwardly against the above separating means.

Preferably, the annular core mold is divided into two to four sections, and more preferably into two sections. A plurality of such core molds revolve around the rotational axis of a turn table rotating horizontally, each core mold revolving horizontally on its own axis together with the separating and uniting means.

Further, a cylindrical casting mold is also divided into two to four sections. A plurality of such core molds are disposed radially and revolve around the rotational axis of a turn table rotating horizontally; each of which revolve vertically on their own axes together with a pair of separating and uniting means provided on both sides of the cylindrical core mold.

BRIEF DESCRIPTION OF THE DRAWINGS

FIGS. 9 to 12 illustrate a third embodiment of the casting mold, i.e., a casting mold of a vertical rotational type for casting cylindrical articles: wherein FIG. 9 is a cross sectional view taken along the line E—E of FIG. 11; FIG. 10 is a cross sectional view taken along the line F—F of FIG. 12; FIGS. 11 and 12 are side vies respectively showing the casting mold in a stationary state and in a rotary state;

DESCRIPTION OF THE INVENTION

A centrifugal casting mold in accordance with the present invention is designed in such a manner that, inner-casting annular core mold halves, which are separated by spring force during the mold stoppage, are integrally combined into a single core mold by utilizing centrifugal force generated during the rotation of the mold so that molten metal can be supplied into the core mold, and that, with the molten metal having solidified and the centrifugal force having disappeared, the core mold halves are to be opened so as to easily remove a casting article out of the mold.

In order to show its particular structures, three kinds of embodiments will now be explained. To be exact, the first and the second embodiments relate to centrifugal casting molds for annular articles of a horizontal rotational type. The third embodiment relates to a centrifugal casting mold for cylindrical articles of a vertical rotational type.

Figure 1:
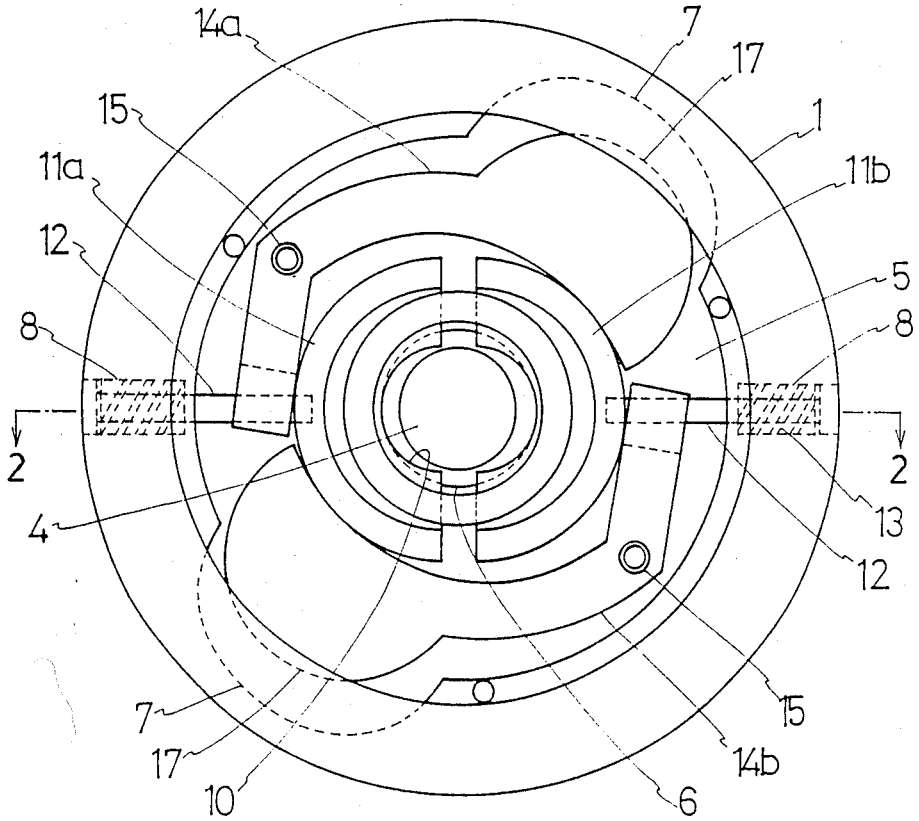
FIG. 1 is a bottom view showing a first embodiment of a centrifugal casting mold in accordance with the present invention.
Figure 2:
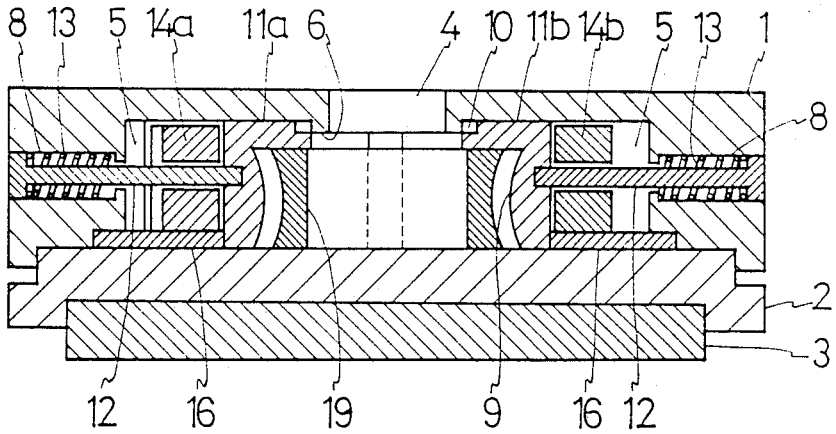
FIG. 2 is a cross sectional view taken along the line A—A of FIG. 1.
Figure 3:
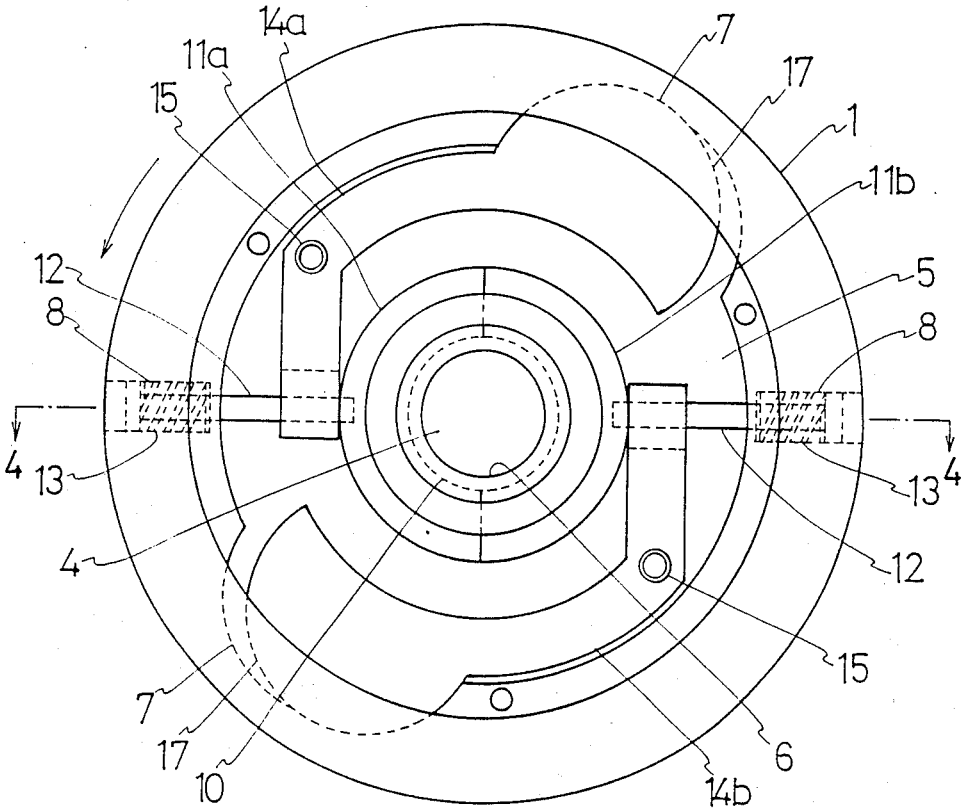
FIG. 3 is a bottom view showing the casting mold under the influence of centrifugal force generated during the mold rotation.
Figure 4:
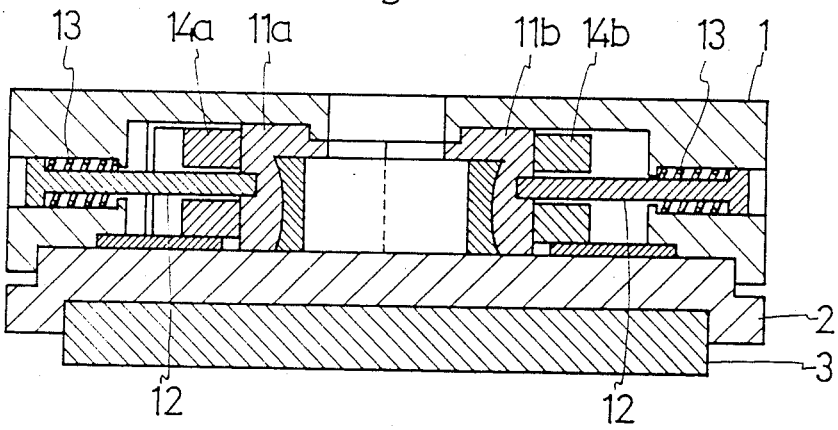
FIG. 4 is a cross sectional view taken along the line B—B of FIG. 3.

The first embodiment is shown in FIGS. 1 to 4, wherein FIGS. 1 and 2 illustrate a mold in a stationary state, and FIGS. 3 and 4 show such a mold in a rotary state. The centrifugal casting mold is so constituted that there are integrally coupled an upper setting mold half 1 which is shaped like a reversed round dish, with a disk-like lower mold half 2 including a stepped portion into which the inner periphery of the upper setting mold half 1 is tightenedly fitted, with these coupled mold halves being mounted on a rotary disk 3 driven by a motor or the like. The upper setting mold half 1 is provided at the center of its upper surface with a circular hole or port 4 for supplying molten metal, and is formed with a circular inner cavity 5 at the inside together with the lower mold half 2. The molten metal supplying port 4 of the upper setting mold half 1 extending at a location as a ceiling over the circular inner cavity 5 has a thickened convex edge 6 provided at its lower side. Arcuate removed sections 7 are formed diametrically opposite with each other at the outer periphery thickened portion of the upper setting mold half 1, and circular apertures 8 are provided passing through the outer periphery thickened portion radially inwardly, which circular apertures 8 likewise extend opposite with each other along the A—A line in FIG. 1. The circular inner cavity 5 contains semi-circular mold surfaces 9 at its central portion, as well as movable core mold halves 11*a*, 11*b* having concave edges 10. These concave edges 10 are tightenedly fitted with the convex edge 6 when the core mold halves are combined to form the circular core mold, having a diameter substantially identical to the diameter of the molten metal supplying port 4 of the upper setting mold half 1. Shafts 12 are respectively connected to the outer walls of these movable core mold halves 11*a*,11*b*, while heads of the shafts 12 are inserted within the circular apertures 8 in the outer peripheral portion of the upper setting mold half 1, and forced radially outwardly by compression springs 13. In this connection, FIG. 1 or FIG. 2 shows such a condition that the central portion of the inner cavity is enlarged when the movable core mold halves have been retracted. Two arcuate centrifugal pendulums 14*a*,14*b* having partly-deformed portions are placed within the circular inner cavity 5 and outside the movable core mold halves 11*a*,11*b*. One end of each centrifugal pendulum 14*a*,14*b* is branched like a fork holding both upper and bottom faces of the shaft 12, and swingably supported by a fulcrum pin 15 to move the core mold half 11*a*,11*b* toward the center of the mold. The other end functions as a centrifugal weight 17 and, as shown in FIG. 3, it is positioned so that a certain portion thereof is received within the removed section 7 serving as a playing region for the centrifugal weight when centrifugal force is affecting it.

In addition, there is provided a ring cover 16 which extends interposing between the upper setting mold half 1 and the lower mold half 2 and having an elliptic opening. The ring cover 16 is attached on the bottom surface of the upper setting mold half 1 mounted on the lower mold half 2 so that, as is clearly seen from FIG. 2, the interior surface of the elliptic opening of the ring cover 16 serves as a retracted position stopper when the movable core mold halves 11*a*,11*b* are retracted.

The operation of the centrifugal casting mold in accordance with the present invention will be described hereinafter. First, as shown in FIG. 1 and FIG. 2, the movable core mold halves 11*a*,11*b* are retracted radially outwardly, and an annular article 19, which has an arcuate groove formed in the outer periphery, is then removed by separating the mold halves vertically, i.e., either by moving the upper setting mold half 1 upwardly or by moving the lower mold half 2 downwardly. Nextly, when the mold is rotated, the weights 17 at the ends of the two centrifugal pendulums 14*a*,14*b* supported by the fulcrum pins 15 are intensely affected by the centrifugal force and displaced radially outwardly to be received in the removed sections 7 inside of the upper setting mold half 1, as shown in FIG. 3 and FIG. 4. Accordingly, the other ends of the centrifugal pendulums 14*a*,14*b* respectively force radially inwardly the movable core mold halves 11*a*,11*b* along the shafts 12 for closedly interconnecting the separated core mold halves 11*a*,11*b* to form an individual circular core mold.

At that time, since the concave edges 10 corresponding to the movable core mold halves 11*a*,11*b* tightenedly fit to the convex edge 6 at the back side of the molten metal supplying port 4 of the upper setting mold half 1, the semi-circular core mold halves 11*a*,11*b* are securely sustained as the circular core mold. In this case, force of the compression springs 13 has to be adjusted so that the above-stated centrifugal pendulums 14*a*,14*b* may bring about enough centrifugal force to withstand the force of the compression springs 13 which separates the semi-circular core mold halves 11*a*,11*b* during the mold stoppage. Besides, according to factors such as a weight of the casting article 19, a size of the movable core mold halves 11*a*,11*b*, a size of the weights 17 of the centrifugal pendulums 14*a*,14*b*, a rotational speed of the casting mold, and the like, the force of the compression springs is to be determined on the basis of certain test data.

When the mold constituted by this way is rotated, the semi-circular core mold halves 11*a*,11*b* are securely fixed into the circular core mold, and a proper quantity of molten metal is thus poured into the core mold through the molten metal supplying port 4 of the mold surface. The poured molten metal is affected by the centrifugal force and finished to be the casting article 19 on the mold surfaces which are the inner walls of the movable core mold halves 11*a*,11*b*, as shown in FIGS. 3 and 4. Thus, when the article 19 solidifies, the mold is stopped from rotating and the centrifugal force disappears with the result, as illustrated in FIGS. 1 and 2, that the centrifugal pendulums 14*a*,14*b* are released from the centrifugal force, whereas the movable core mold halves 11*a*,11*b* are retracted radially outwardly by the compression springs 13, thereby enabling the article 19 to be removed out of them. In this case, a range of clearance as the core mold halves 11a,11b retracted is restricted within the boundary of the elliptic opening of the ring cover 16.

Next, the second embodiment will be explained. Instead of attaching the weights 17 integrally to the centrifugal pendulums 14a,14b as in the first embodiment, separated members of weights 17 may be employed at the corresponding positions for adding weight to the centrifugal pendulums so as to realize the present invention.

Figure 5:
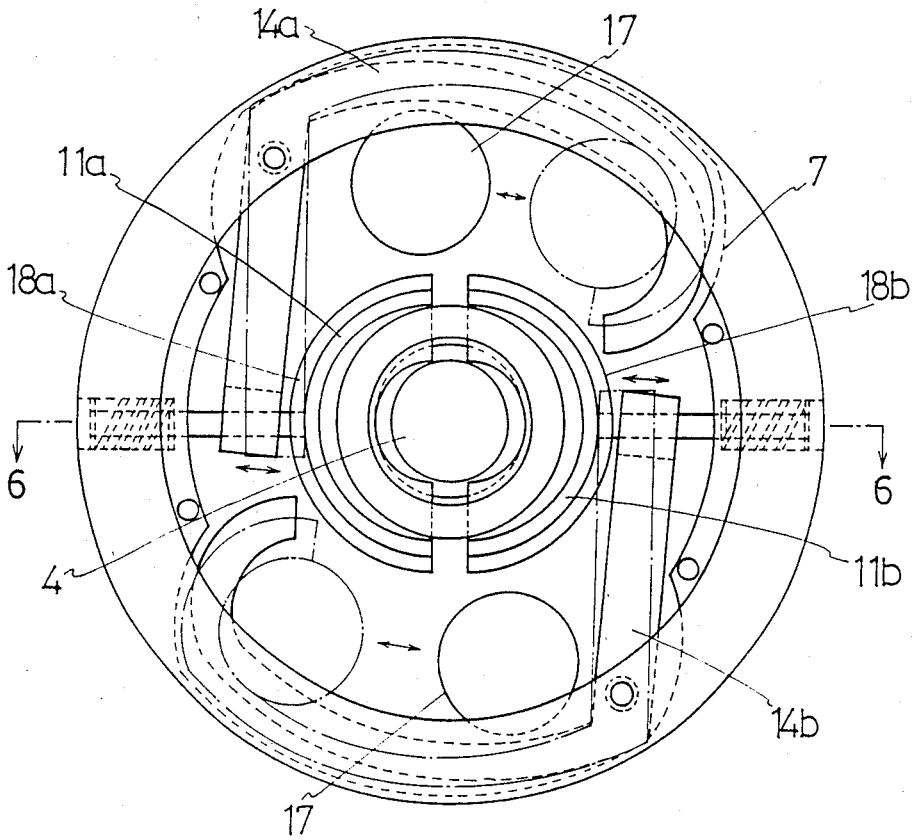
FIG. 5 is a bottom view showing a second embodiment of the casting mold.
Figure 6:
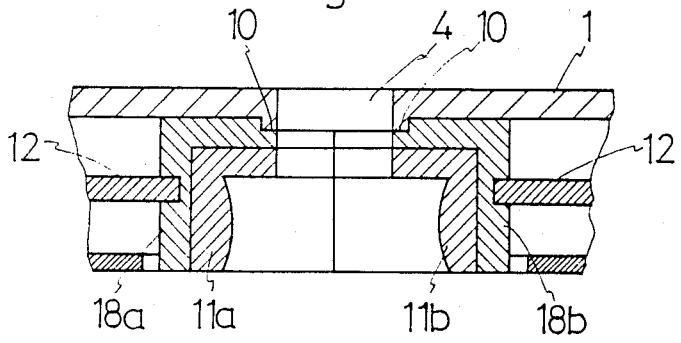
FIG. 6 is an enlarged view showing a central portion of the mold in cross section taken along the line C—C of FIG. 5, when the mold is affected by the centrifugal force generated during the mold rotation.

This second embodiment is illustrated in FIGS. 5 and 6, while there are two differences from the first embodiment shown in FIGS. 1 to 4. One is found in a relationship between the centrifugal pendulums 14a,14b and the weights 17. One end of each centrifugal pendulum 14a,14b is placed behind the movable core mold half 11a,11b, whereas the other end portion is received in the spacious removed section 7 of the outer peripheral portion of the upper setting mold half 1 except the distal end of the other end portion positioned in the circular inner cavity 5, which is embracingly L-shaped for readily containing the weights 17. The difference in question is that both of the weights 17 are shaped like disks and received freely movably in certain regions of the circular inner cavity 5 which are exclusively defined by the centrifugal pendulums 14a,14b. Being affected by the centrifugal force generated by the mold rotation, the centrifugal pendulums 14a,14b are displaced from the solid-line positions to the chain-line positions, with the weights 17 being simultaneously moved, and consequently, the rear ends of the centrifugal pendulums force the movable core mold halves 11a,11b radially inwardly to make them into the integrally coupled circular core mold.

The second difference is found in the movable core mold halves 11a,11b, as shown in FIG. 6, whose characteristics reside in that such necessarily exchangeable core mold halves are contained in outer shells 18a,18b shaped for overlapping them from behind, while these outer shells 18a,18b provided with the concave edges 10 and the shafts 12 are placed in the circular inner cavity 5, which outer shells 18a,18b alone are in permanent use. As an alternative to the molds explained in these first and second embodiments, by the way, instead of employing a pair of the centrifugal pendulums 14a,14b and a pair of the weights 17, three or four sets of such members can be respectively used in the same manner.

With regard to the operation of the casting mold according to the second embodiment, a difference from the first embodiment is, as mentioned above, to be only found in the relationship between the centrifugal pendulums 14a,14b and the weights 17. In other words, the weights 17 located as the solid lines in FIG. 5 are automatically contained in the distal ends of the centrifugal pendulums 14a,14b owing to the mold rotation, and then, as the centrifugal force is increased in response to accelerated rotation, they force the distal ends of the centrifugal pendulums 14a,14b radially outwardly to be received in the removed sections 7, as shown by the chain lines in the figure. The other ends of the centrifugal pendulums 14a,14b, therefore, respectively move the semi-circular core mold halves 11a,11b radially inwardly to combine them integrally into the securely fixed circular core mold. Then, after the article 19 has been cast, when the mold is stopped from rotating, the centrifugal pendulums 14a,14b are released from the centrifugal force, and the movable core mold halves 11a,11b are retracted by the compression springs 13, the weights 17 going out of the contained positions. Eventually, after raising the upper setting mold half 1 and removing the casting article 19 placed on the surface of the lower mold half 2, the mold is to be cleaned and sprayed cleaning wax over for repeating the operation of assembling and rotating the mold.

One preferred embodiment of an apparatus for continuously supplying molten metal of one dose or constant-quantity molten metal to the above-stated centrifugal casting molds of the horizontal rotational type will be described with reference to FIG. 7 and a cross sectional view taken along the line D—D of FIG. 8.

Figure 7:
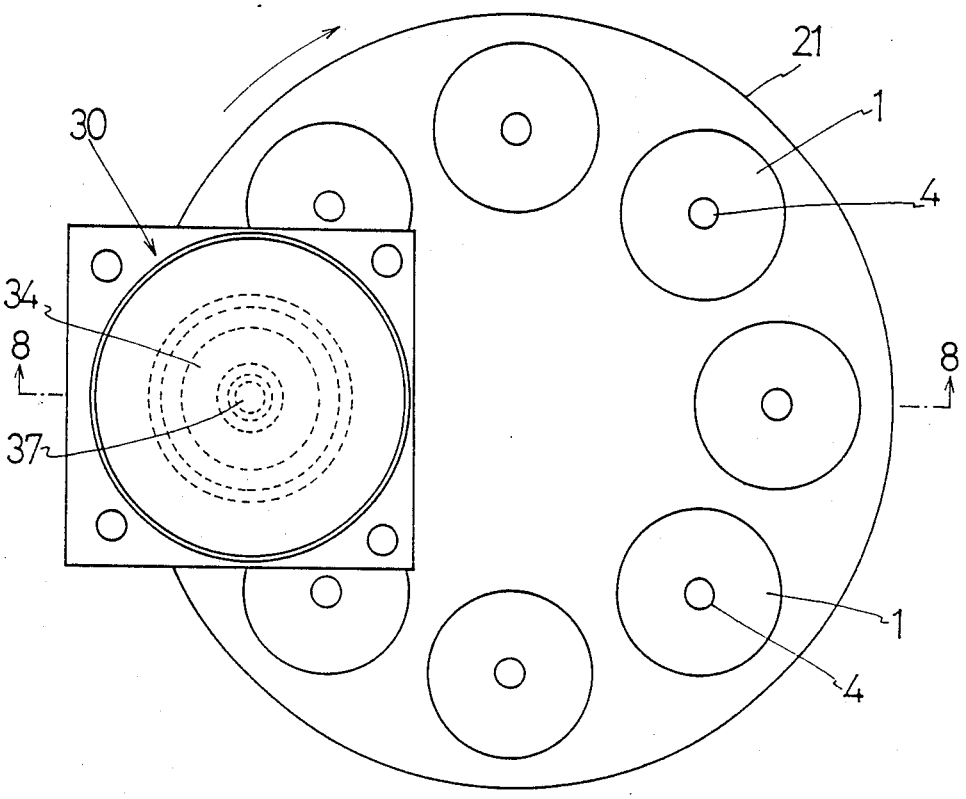
FIG. 7 is a plane view showing a continuous centrifugal casting apparatus of casting molds of a horizontal rotational type provided with the molds illustrated in FIGS. 1 to 6 of the present invention.
Figure 8:
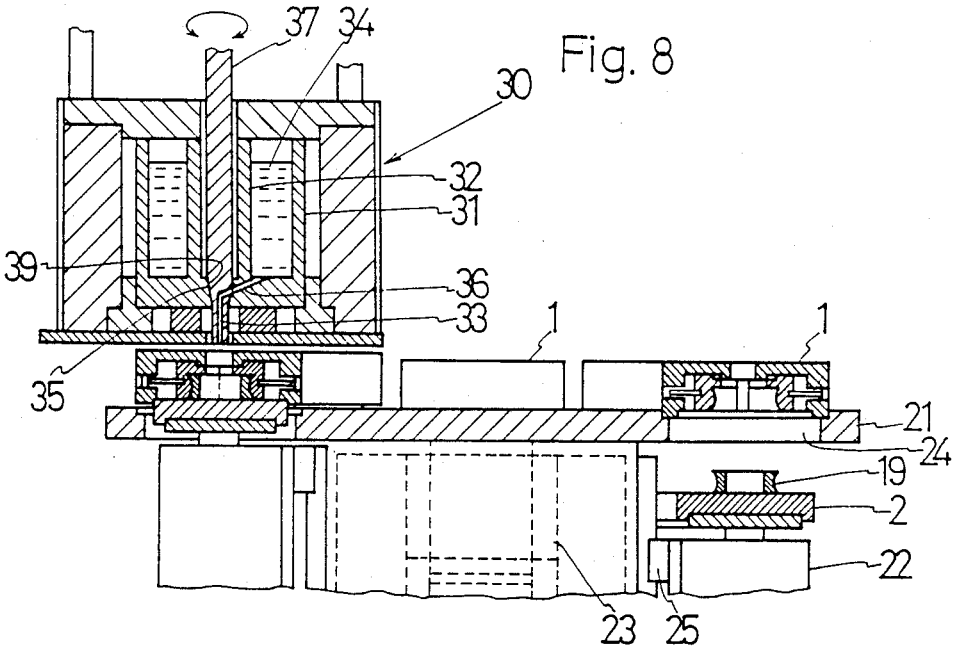
FIG. 8 is a cross sectional view showing a main part of FIG. 7 taken along the line D—D.
Figure 9:
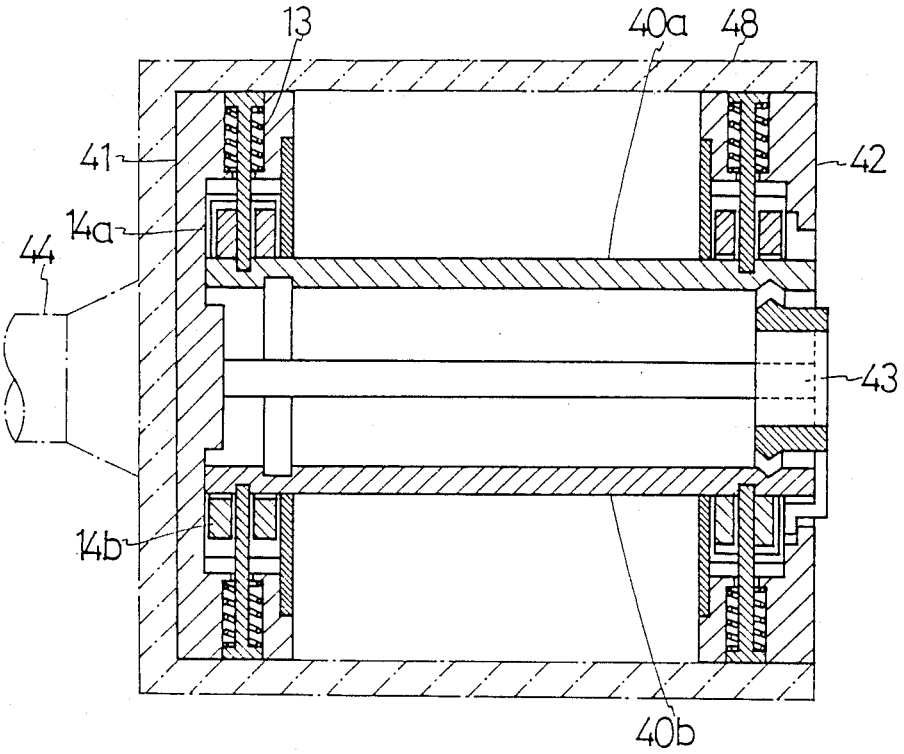
Figure 10:
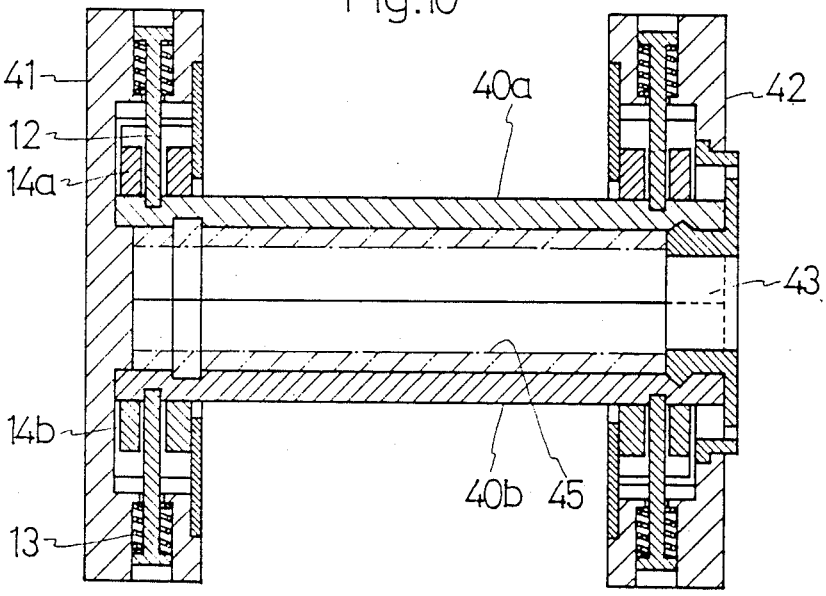

As fully illustrated in FIG. 7, eight centrifugal casting molds are mounted on a turn table 21, whose upper setting mold halves 1 are respectively set over stepped bores 24 in the outer peripheral portion of the turn table 21, while the corresponding lower mold halves 2 are placed in the bores of the turn table 21 so as to be detached and moved downwardly together with the casting articles 19, being provided with motors 22 for high-speed rotation. Housing of each motor 22 is connected to a vertical slider 25 and moved upwardly or downwardly by means of an air cylinder or the like (not shown).

The turn table 21 is driven by an additional motor 23 with a positioning device and controlled for each of the casting molds to be intermittently moved immediately under the one-dosed molten metal supplying apparatus 30.

After each lower mold half 2 has been moved upwardly with the housing of the motor 22, so as to be combined with the corresponding upper setting mold half 1, and when such combined mold is lifted slightly above the turn table 21, it starts to be rotated on its own axis by the motor 22. In such a condition, the mold is then displaced directly under the one-dose molten metal supplying apparatus 30, supplied with molten metal into it, and transferred again by rotating the turn table 21, and then, when it comes to a position which can be seen at the right side of FIG. 8, the lower mold half 2 is detached and moved downwardly together with the casting article 19, which is to be removed out of the mold.

The one-dose molten metal supplying apparatus 30 according to the present invention is mainly characterized by comprising a conical taper bearing 35 provided below a molten metal container 34 of a container furnace 31; a rod 37 for connecting/disconnecting molten metal runners, the rod including a tapered rod end 39, with which the above taper bearing 35 is tightenedly fitted; the molten metal inlet runner 36 passing from the above molten metal container 34 to the taper bearing 35; and the molten metal outlet runner 33 provided in the above tapered rod end 39, which is to be connected with the molten metal inlet runner 36 when the connecting/disconnecting rod 37 is rotated on its own axis for discharging the molten metal out of the molten metal container 34.

Such a structure is particularly desirable that the connecting/disconnecting rod 37 is inserted within a protective partition wall 32 for avoiding direct contact with the molten metal, thereby preventing this connecting/disconnecting rod 37 from heat wear.

The connecting/disconnecting rod 37 can be rotated in a manner of inversely repeated rotation, e.g., an angle of 90 degrees clockwise and the same angle of 90 degrees counterclockwise to be replaced in the former position, or in a manner of one-way rotation.

As described above, in the one-dose molten metal supplying apparatus 30 in accordance with the present invention, because the connection between the taper bearing 35 and the tapered rod end 39 is the contact of the conical surfaces which are tapered for fitting to each other, the connecting/disconnecting rod 37 can be easily rotated on its own axis, and such operation of rotating the connecting/disconnecting rod 37 enables the molten metal supply to start or stop readily and safely. Besides, if we change a length of time to maintain the "connecting" state of the molten metal runners, i.e., the state of the molten metal inlet runner 36 connected with the molten metal outlet runner 33 by means of the connecting/disconnecting rod 37, the molten metal of a certain quantity can be supplied into the mold. Moreover, the complete connection of the inlet runner 36 with the outlet runner 33 requires the tapered rod end 39 and the taper bearing 35 to be tightenedly fitted. The surfaces of these portions, however, are tapered to fit to each other in such a manner that the complemental contact between the tapered rod end and the taper bearing can be realized without difficulty, which never causes trouble molten metal leakage at the contact surfaces of the runners. Furthermore, the entrance runner 36 and the exit runner 33 are usually heated to an appropriate degree by heat of the molten metal so that an additional heating device to prevent the molten metal from solidifying while passing these runners is not necessary. As for the connecting/disconnecting rod 37, being inserted within the protective partition wall 32, it will not be damaged immediately by high temperature of the molten metal, and therefore, it will be almost protected from the influence of heat wear, which leads to the longer life of the connecting/disconnecting rod 37.

Figure 11:
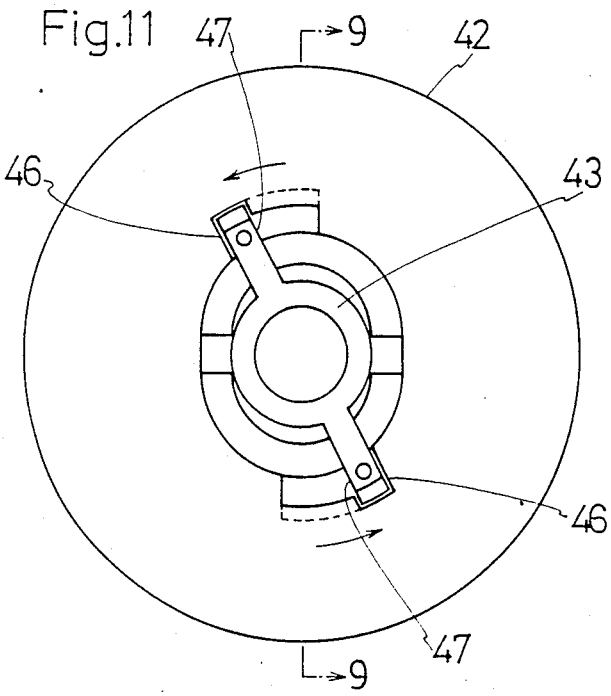
Figure 12:
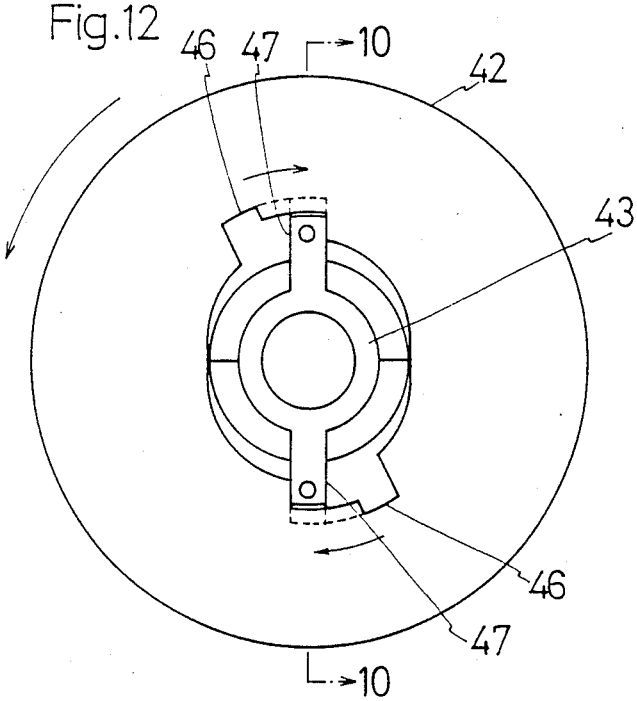

In the third embodiment, the present invention is applied to casting of cylindrical articles as a centrifugal casting mold of the vertical rotational type, as shown, e.g., in FIGS. 9 to 12. In this case, movable semi-cylindrical core mold halves **40*a*,40*b* are extended horizontally and supported by two molding members, which are provided on the left and the right sides of the core mold halves 40*a*,40*b*, and whose structures are practically the same as that of the upper setting mold half 1 shown in FIG. 1. For convenience' sake, we hereinafter call such molding members a left support molding member 41 and a right support molding member 42 respectively. While the left support molding member 41 is of a blind or closed type and the right support molding member 42 is of an open type in which central portion is provided a molten metal supplying port adapter 43, either of these molding members 41,42 contains in the inside the shafts 12 supporting the movable core mold halves 40*a*,40*b*, the compression springs 13 for the shafts, and the centrifugal pendulums 14*a*,14*b* including the weights, all in the same manner as the above-mentioned upper setting mold half 1. Accordingly, in a stationary state illustrated in FIG. 9, the movable core mold halves 40*a*,40*b* are vertically retracted by the force of the compression springs. When they are enclosed within an outer envelope 48 which is indicated with the phantom line in the drawing, and rotated in a vertical plane around a rotational axis 44 extending horizontally, the centrifugal pendulums 14*a*,14*b* are displaced by the centrifugal force, and thus, the core mold halves 40*a*,40*b* are integrally combined to form a cylindrical core mold, to which the molten metal is to be supplied for casting a cylindrical article 45. Since the molten metal supplying port adapter 43 is required to be detached to remove the casting article 45 out of the core mold, notches 46,46 are diametrically formed on the edge of the opening of the molten metal supplying port of the right support molding member 42, and correspondingly, protrusions 47,47 are extended from the molten metal supplying port adapter 43 so as to be rotationally engaged in the notches 46,46. FIG. 11 shows the stationary state in which the movable core mold halves 40*a*,40*b* are retracted vertically, with the port adapter 43 being free to be removed, and on the contrary, FIG. 12 shows the rotary state in which the port adapter 43** is tightenedly fixed.

Figure 13:
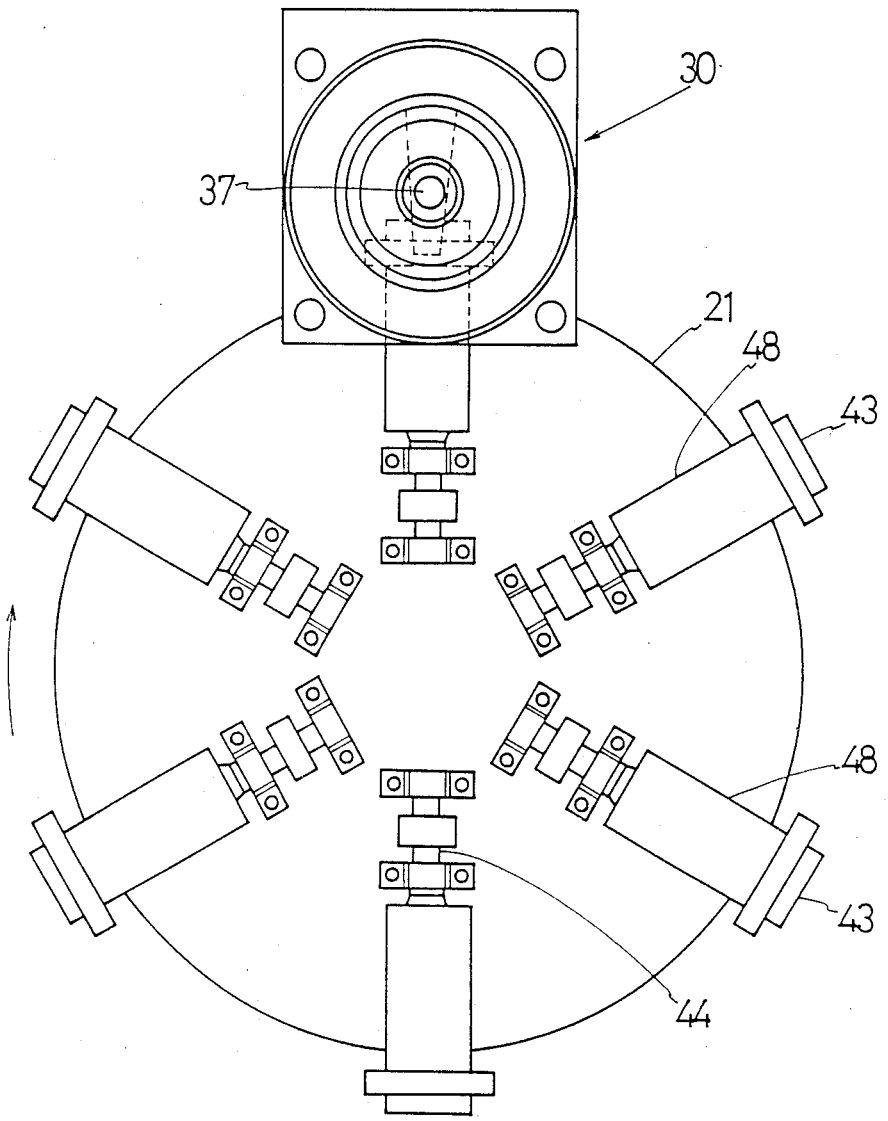
FIG. 13 is a plane view showing a continuous centrifugal casting apparatus of casting molds of the vertical rotational type provided with the molds illustrated in FIGS. 9 to 12.

FIG. 13 illustrates a continuous centrifugal casting apparatus of the casting molds of the vertical rotational type shown in FIGS. 9 to 12. In this case, also, on the turn table 21 are radially mounted six of the outer envelopes 48, each of which contain in themselves the left and the right support molding members 41,42 with the movable core mold halves **40*a*,40*b*, as well as the one-dose molten metal supplying apparatus 30** provided at one spot on the turn table, in order to complete the continuous centrifugal casting apparatus. Because this apparatus is operated exactly in the same method as the horizontal rotational type molds, its explanation will be omitted.

Other than that, if a plurality of annular molding grooves are formed in the inner surfaces of the semi-cylindrical core mold halves **40*a*,40*b***, the same number of annular articles can be cast in the single cylindrical core mold, which leads to more efficient production.

Figure 14:
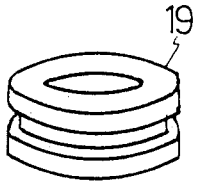
FIGS. 14 to 17 are diagrammatical perspective views showing casting articles which can be produced with the casting apparatus of FIG. 7.
Figure 15:
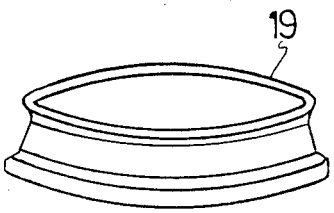
Figure 16:
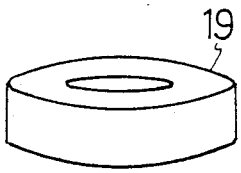
Figure 17:
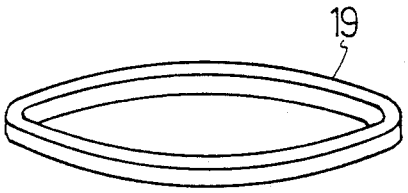

By putting the present invention into practice as previously described, annular or cylindrical articles having grooves or protrusions provided to the outer periphery may be automatically manufactured at high speed. As well, the invention is applicable to casting articles with flat surfaces. Shapes of the articles are concretely illustrated in FIGS. 14 to 19, wherein FIGS. 14 to 17 show annular articles, which can be easily produced with the apparatus of the first and the second embodiments FIG. 14 shows an annular collar, a great number of which are employed for the automobile compressors and air conditioners; FIG. 15 a seal ring for the caterpillars of civil engineering machines such as bulldozers; FIG. 16 an annular bush for the mechanical apparatus of various kinds; and FIG. 17 a thin ring which is used as a piston ring.

Figure 18:
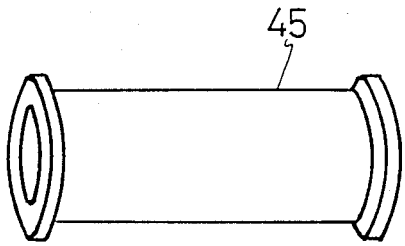
FIGS. 18 and 19 are diagrammatical perspective views showing casting articles which can be produced with the casting apparatus of FIG. 13.
Figure 19:
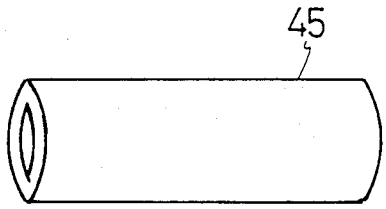

FIGS. 18 and 19 show cylindrical articles, a large number of which are in use for the piston cylinders and so on.

Articles without having grooves or protrusions provided to the outer periphery can be cast in a onepiece centrifugal casting mold which is draft-angled, and in such a case, it is until each article has cooled, hardened, and at the same time contracted sufficiently that it is removed out of the casting mold. As for the mold of the integrally coupled mold halves according to the present invention, however, after pouring the molten metal into the mold, when the article solidifies to such a degree that it is not to be deformed, that is to say, even when the article is in a red-hot state, it can be removed out of the mold. And this fact helps to shorten the centrifugal casting time of the article, and in consequence, serves to realize its massproduction. In addition, the red-hot article can be taken out of the mold and introduced as it is into a tunnel-type thermal treatment furnace, so that thermal treatment may be readily performed within a short period of time without any heat loss.

What is claimed are:

1. A centrifugal casting mold comprising radially plurality divided core mold sections; separating means for respectively separating said divided core mold sections at predetermined intervals when the mold is in a stationary state; and centrifugal pendulums serving as uniting means for displacing the respective divided core mold sections inwardly to thereby combine them integrally when the mold is rotating, which centrifugal pendulums are supported with the centers of gravity being one-sided, while one end of each pendulum is adapted to force the rear side of the corresponding core mold section against said separating means.

2. A centrifugal casting mold according to claim 1, wherein an annular core mold is divided into two sections, and a plurality of the core molds revolve around the rotational axis of a turn table rotating horizontally, each of which revolve horizontally on their own axes together with the separating and uniting means.

3. A centrifugal casting mold according to claim 1, wherein a cylindrical core mold is longitudinally divided into two sections, and a plurality of the core molds are radially disposed and revolve around the rotational axis of a turn table rotating horizontally, each of which revolve vertically on their own axes together with pairs of separating and uniting means provided on both sides of the cylindrical core molds.

* * * * *